US008339047B2

(12) United States Patent
Gesche et al.

(10) Patent No.: US 8,339,047 B2
(45) Date of Patent: Dec. 25, 2012

(54) ELECTRODE FOR A PLASMA GENERATOR

(75) Inventors: Roland Gesche, Seligenstadt (DE); Andreea Cristina Andrei, Petershagen (DE); Stephan Buchholz, Berlin (DE); Silvio Kuehn, Bernau (DE)

(73) Assignee: Forschungsverbund Berlin E.V., Berlin (DE)

( * ) Notice: Subject to any disclaimer, the term of this patent is extended or adjusted under 35 U.S.C. 154(b) by 398 days.

(21) Appl. No.: 12/451,139

(22) PCT Filed: Mar. 25, 2008

(86) PCT No.: PCT/EP2008/053507

§ 371 (c)(1),
(2), (4) Date: Feb. 25, 2010

(87) PCT Pub. No.: WO2008/131997

PCT Pub. Date: Nov. 6, 2008

(65) Prior Publication Data

US 2010/0171425 A1 Jul. 8, 2010

(30) Foreign Application Priority Data

Apr. 27, 2007 (DE) ..... 10 2007 020 419

(51) Int. Cl.
*H01J 7/24* (2006.01)
*H05B 31/26* (2006.01)

(52) U.S. Cl. ..... 315/111.21; 315/111.31

(58) Field of Classification Search ..... 315/111.21, 315/111.31, 111.41, 111.51, 111.61, 111.71, 315/111.81

See application file for complete search history.

(56) References Cited

U.S. PATENT DOCUMENTS

| | | | | |
|---|---|---|---|---|
| 3,848,196 | A | 11/1974 | Kawamoto et al. | |
| 4,339,691 | A * | 7/1982 | Morimiya et al. | 315/111.21 |
| 5,537,004 | A * | 7/1996 | Imahashi et al. | 315/111.21 |
| 5,838,111 | A * | 11/1998 | Hayashi et al. | 315/111.21 |
| 6,759,808 | B2 * | 7/2004 | Grotjohn et al. | 315/111.71 |
| 6,917,165 | B2 * | 7/2005 | Hopwood et al. | 315/111.21 |
| 7,097,695 | B2 * | 8/2006 | Lau et al. | 96/29 |
| 7,241,428 | B2 * | 7/2007 | Chiu | 422/186 |

FOREIGN PATENT DOCUMENTS

| | | |
|---|---|---|
| DE | 38 30 430 A1 | 3/1989 |
| DE | 199 55 671 A1 | 5/2001 |

(Continued)

OTHER PUBLICATIONS

International Search Report, dated Jul. 11, 2008, corresponding to PCT/EP2008/053507.

(Continued)

*Primary Examiner* — Minh D A

(74) *Attorney, Agent, or Firm* — Christie, Parker & Hale, LLP

(57) ABSTRACT

The invention relates to an electrode for a plasma generator for generating plasmas at atmospheric pressure or near-atmospheric pressures by means of excitation using microwaves. The invention provides an electrode made of a sheet metal strip (1), in the longitudinal direction of which at least one slot (2) is introduced at a length that is one time or multiple times that of a quarter of the wavelength of the open-circuit voltage of the microwave such that at least two partial electrodes (3) are formed, wherein the voltage supply line is provided on the partial electrodes (3) in the region of the closed slot end or ends.

11 Claims, 2 Drawing Sheets

FOREIGN PATENT DOCUMENTS

Figure 1:
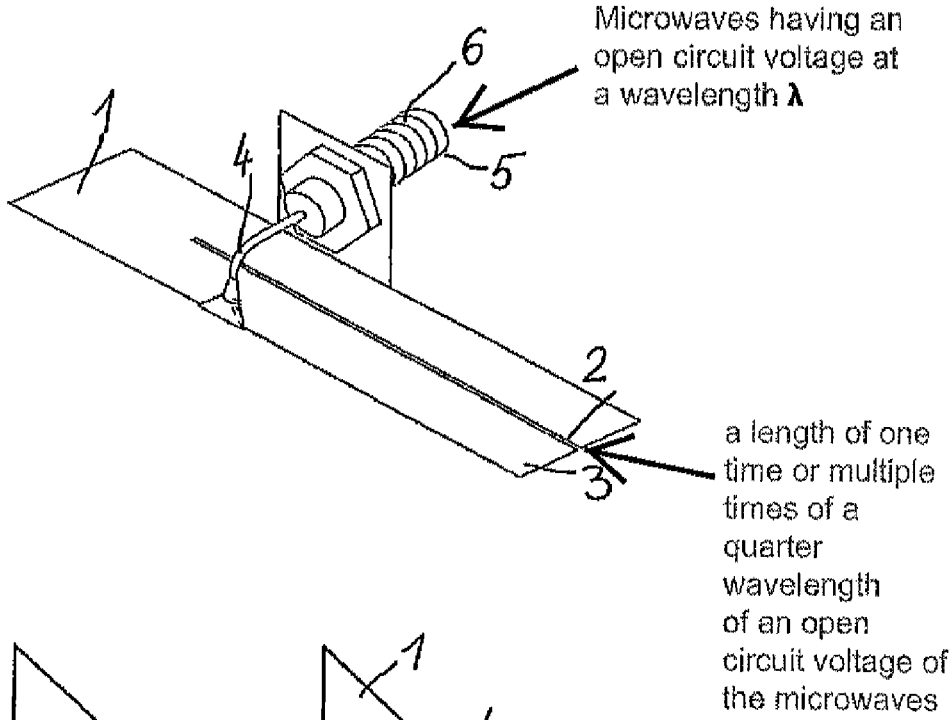

| | | | |
|---|---|---|---|
| DE | 103 35 523 | A1 | 5/2005 |
| EP | 0 989 589 | A1 | 3/2000 |
| WO | WO 03/039214 | A1 | 5/2003 |
| WO | WO 2004/062326 | A2 | 7/2004 |

OTHER PUBLICATIONS

Kim, et al., "2.45 GHz microwave-excited atmospheric pressure air microplasmas based on microstrip technology," Applied Physics Letters, 191504, vol. 86, No. 19, May 9, 2005. pp. 191504-1 to 191504-3, XP012065308.

Schutze, et al., "The Atmospheric-Pressure Plasma Jet: A Review and Comparison to Other Plasma Sources," IEEE Transactions on Plasma Science, vol. 26, No. 6, Dec. 1998, pp. 1685-1694.

Laroussi, "Nonthermal Decontamination of Biological Media by Atmospheric-Pressure Plasmas: Review, Analysis, and Prospects," IEEE Transactions on Plasma Science, vol. 30, No. 4, Aug. 2002, pp. 1409-1415.

* cited by examiner

ELECTRODE FOR A PLASMA GENERATOR

CROSS-REFERENCE TO RELATED APPLICATION

This application is a National Phase Patent Application and claims the priority of International Application Number PCT/EP2008/053507, filed on Mar. 25, 2008, which claims priority of German Patent Application Number 10 2007 020 419.3, filed on Apr. 27, 2007.

The invention relates to an electrode for a plasma generator for generating plasmas at atmospheric pressure or near-atmospheric pressure through excitation with microwaves.

Plasmas are employed in numerous sedimentation, etching and layer-forming processes.

Recently, attempts have been made to generate suitable low-temperature plasmas also under non-vacuum conditions. Such reactors operate with corona discharges or glow discharges. An overview over plasma generators of this type can be found in Laroussi, Nonthermal Decontamination of Biological Media by Atmospheric-Pressure Plasmas: Review, Analysis and Prospects, IEEE Transactions on Plasma Science, Vol. 30, No. 4, August 2002, Pages 1409-1415, or in Schütze et al., The Atmospheric-Pressure Plasmas Jet: A Review and Comparison to Other Plasma Sources, ibid., Vol. 26, No. 6, December 1998. The plasma reactors described herein are intended to be used, inter alia, for biological and medical purposes. In addition to the high costs associated with plasma reactors operating under vacuum, reduced pressure operation is frequently not feasible, so that the plasma must be applied at atmospheric pressure. Moreover, materials which are sensitive to exposure to vacuum, such as certain polymers or sensitive food products, can be treated with low-temperature plasmas at atmospheric or near-atmospheric pressure.

Plasma generators require high-power power supplies, although the high-power is required only for ignition.

The electrode spacing always requires a compromise between ignition characteristic and stable plasma operation. Small electrode spacings, which are optimal for ignition, produce very small plasma volumes and highly localized stress on of the electrodes. Larger electrode spacings result in extremely high ignition voltages and unstable plasma operation.

It is an object of the invention to provide an electrode for plasma generators which reliably ignites at small power levels, particularly in a pressure range near atmospheric pressure, and which is capable of generating a plasma of sufficiently high density so as to activate a continuous gas flow with high efficiency.

The object is attained by the invention with an electrode having the features of claim 1. Advantageous embodiments are recited in the dependent claims.

Accordingly, the electrode is made of a sheet metal strip which has at least one slot extending in the longitudinal direction with a length that is one time or a multiple times a quarter wavelength of the open-circuit voltage of the microwave, so that at least two partial electrodes are formed, wherein the voltage is supplied to the partial electrodes in the region of the closed slot end or ends.

The electrode of the invention produces, when taking into consideration the excitation frequency under open-circuit conditions, a geometric location of high field strength where the plasma is ignited. After the plasma has been ignited, the field distribution in the electrode structure changes due to the plasma impedance and the plasma migrates to a different location and/or broadens inside the electrode slot and expands into a larger volume.

The structure of the electrode exploits frequency-dependent resonant properties of the structure and generates a high electric field strength at a predefined location, enabling ignition of the plasma. The strong field is typically produced on at least two opposing, closely spaced electrodes. When electric power is introduced into the structure at a suitable location in form of microwaves, a high alternating potential difference is produced at the end of the slot. The resulting field strength is very high due to the small separation between the opposing electrodes. When the supplied power is sufficiently high, a plasma can be ignited at atmospheric pressure or near-atmospheric pressure at the location where the electric field strength is highest. After ignition, only a fraction of the required ignition power is required for continued operation. The frequency of the supplied power depends on the physical dimensions of the electrode. In particular, the length of the slot has a significant effect on the frequency and is approximately equal to a multiple of a quarter wavelength.

Electric power is supplied to a slot that is open on one side, for example, by a coaxial line, wherein the inner conductor of the coaxial line is routed to a location on one side of the slot where approximate matching occurs in open-circuit operation.

Configurations with a slot that is closed on both sides are also feasible. The highest electric field, and hence also the plasma, are then generated at the center of the slot. Advantageously, the electrode is here bent into a U-shape or a circular shape.

In the latter case, power is supplied, for example, by a coaxial line, wherein the inner conductor branches in the shape of a T and is routed on both sides to the electrode in the region of the two slot ends.

For example, for treatment of process gases, the electrode is advantageously surrounded by a shielded housing, which has an opening for supplying the process gases and an additional opening for discharging the process gases following activation by the plasma. The openings should have dimensions so as to keep emission of microwave energy at permissible levels.

In a preferred embodiment, the electrode is powered by a free-running oscillator circuit, with the electrode itself forming the frequency-determining element. The oscillator circuit and the electrode can be integrated in a single unit.

Preferably, the electrode can be used for medical treatment applications, in particular for treatment of human skin, but also for modifying this surface energy of workpieces or for plasma-chemical deposition of layers.

Figure 2:
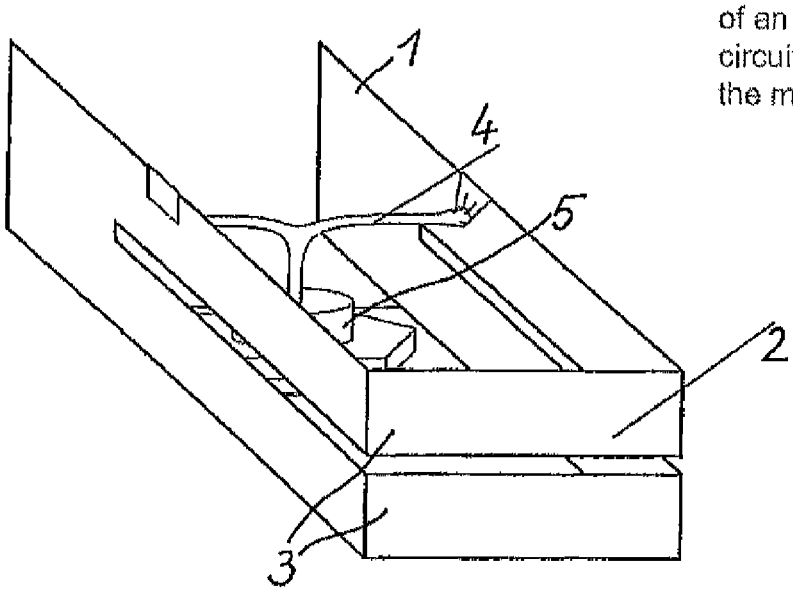
Figure 3:
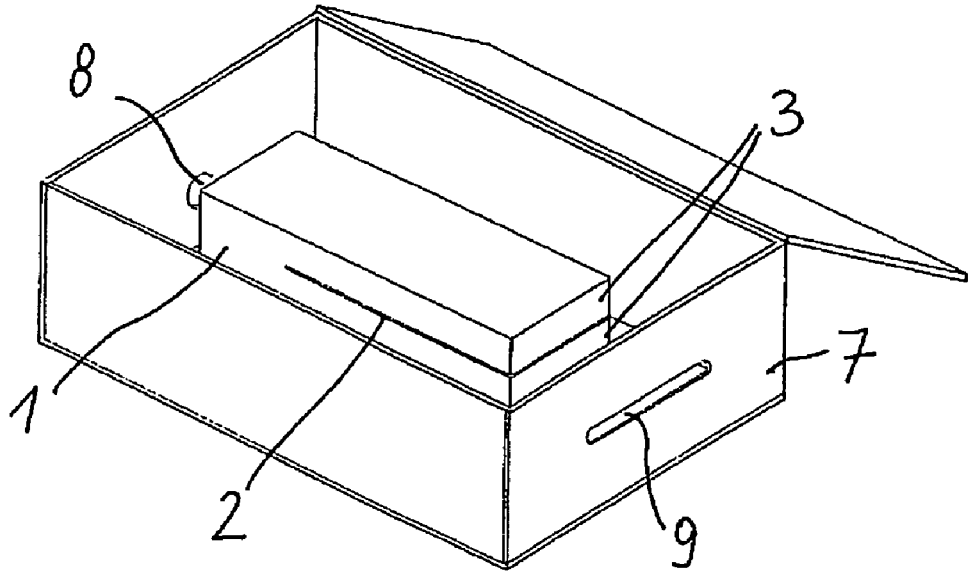

The invention will now be described in more detail with reference to two exemplary embodiments. The appended drawings show in:

FIG. 1 an example of an electrode of a resonator according to the invention, FIG. 2 an example for a closed structure of an electrode of a resonator, and FIG. 3 the resonator of FIG. 2 inserted in a housing.

FIG. 1 shows an exemplary embodiment of a resonator of a plasma generator. A slot 2 is disposed in a sheet metal strip 1 which operates as electrode. The slot 2 divides the sheet metal strip 1 into two partial electrodes 3, which generate a high electric field strength when operated at a high-frequency voltage that is supplied to the sheet metal strip 1 via the inner conductor 4 of a coaxial line 5. The slot 2 has typically a length of $\lambda/4$. In an actually device operating with a supply voltage at a frequency of 2 GHz, the slot has a length of 37.5 mm, and the slot width is 0.1 mm. In the region of the slot end, the inner conductor 4 of the coaxial line 5 extends to the outer edge of the sheet metal strip 1 to a location, where resonance is generated with an oscillator. The outer conductor 6 of the coaxial line 5 is routed to the outer edge of the sheet metal strip 1 located at the opposite side of the sheet metal strip 1.

An applied supply voltage produces a high field strength at the slot end which is sufficient to ignite a plasma at atmospheric pressure. After ignition, the plasma moves into the slot 2 and increases in volume, while exhibiting stable characteristics.

FIG. 2 shows an electrode made of a sheet metal strip 1 bent into a U-shape and having a slot 2. The slot 2 has in this example a length of $\lambda/2$. The inner conductor 4 of the coaxial line 5 branches in the shape of a T and extends to the two opposing sides of the sheet metal strip 1 in the region of the slot end. The outer conductor 6 is connected to the opposing sides of the sheet metal strip 1. In this embodiment, the highest field strength is produced at the center of the slot 2, i.e., at the front edge of the sheet metal strip 1. After the plasma has been ignited at this location, the plasma expands at least over the entire region of the front edge of the sheet metal strip 1.

An electrode for a plasma generator for generating a plasma at atmospheric pressure or near-atmospheric pressures through excitation with microwaves, comprising: a sheet metal strip 1 having at least one slot 2 extending in a longitudinal direction and having a length of one time or multiple times a quarter wavelength of an open-circuit voltage of the microwaves, said slot dividing the sheet metal strip 1 into at least two partial electrodes 3, wherein the at least one slot 2 has at least one closed end and an excitation voltage is supplied to the at least two partial electrodes 3 in a region of the at least one closed slot end.

FIG. 3 shows schematically the configuration of a resonator finished with a housing 7. The housing 7 (shown here in an essentially open configuration) is reflecting and hence prevents emission of electromagnetic radiation to the outside. A process gas is treated with this plasma generator by providing a gas supply line 8 in the rear housing wall and a slotted gas discharge line 9 in the front wall.

LIST OF REFERENCE SYMBOLS

1 Sheet metal strip
2 Slot
3 Partial electrode
4 Inner conductor
5 Coaxial line
6 Outer conductor
7 Housing
8 Gas supply line
9 Gas discharge line

The invention claimed is:

1. An electrode for a plasma generator for generating a plasma at atmospheric pressure or near-atmospheric pressures through excitation with microwaves, comprising:

a sheet metal strip having at least one slot extending longitudinally to a propagation direction of the microwaves and having a length of one time or multiple times a quarter wavelength of an open-circuit voltage of the microwaves, said slot dividing the sheet metal strip into at least two partial electrodes, wherein the at least one slot has at least one closed end and an excitation voltage is supplied to the at least two partial electrodes in a region of the at least one closed slot end for generating the plasma between sides of the at least one slot, wherein the excitation voltage is supplied through a coaxial feed having an inner conductor extending on one side of the at least one slot to a location where approximate matching is attained under open-circuit conditions.

2. The electrode according to claim 1, wherein the at least one slot has two ends, with one of the ends being closed and the other end being open.

3. The electrode according to claim 1, wherein the at least one slot has two ends, with both ends being closed.

4. The electrode according to claim 3, wherein the at least two partial electrodes of the electrode are bent into a U-shape.

5. The electrode according to claim 3, wherein the at least two partial electrodes of the electrode are bent into a circular shape.

6. The electrode according to claim 3, wherein the excitation voltage is supplied through a coaxial feed having an inner conductor that branches in a shape of a T and extends to the at least two partial electrodes on both sides in a region of the two slot ends.

7. The electrode according to claim 1, further comprising a shielded housing enclosing the electrode.

8. The electrode according to claim 7, wherein the shielded housing comprises an opening for supplying process gases and an additional opening for discharging the process gases that are activated by the plasma.

9. The electrode according to claim 1, wherein the electrode is supplied by a free-running oscillator circuit, wherein the electrode itself is a frequency-setting element.

10. The electrode according to claim 9, wherein the electrode is integrated with the free-running oscillator circuit.

11. An electrode for a plasma generator for generating a plasma at atmospheric pressure or near-atmospheric pressures through excitation with microwaves, comprising:

a sheet metal strip having at least one slot extending in a longitudinal direction and having a length of one time or multiple times a quarter wavelength of an open-circuit voltage of the microwaves, said slot dividing the sheet metal strip into at least two partial electrodes, wherein the at least one slot has at least one closed end and an excitation voltage is supplied to the at least two partial electrodes in a region of the at least one closed slot end, wherein the at least one slot has two ends, with both ends being closed, and wherein the excitation voltage is supplied through a coaxial feed having an inner conductor that branches in a shape of a T and extends to the at least two partial electrodes on both sides in a region of the two slot ends.

* * * * *